US008006528B2

(12) United States Patent
Osako

(10) Patent No.: US 8,006,528 B2
(45) Date of Patent: Aug. 30, 2011

(54) METHOD FOR PRODUCING DUPLEX STAINLESS STEEL PIPE, METHOD FOR STRAIGHTENING, METHOD FOR REGULATING STRENGTH, AND METHOD FOR OPERATING STRAIGHTENER

(75) Inventor: Hajime Osako, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/458,508

(22) Filed: Jul. 14, 2009

(65) Prior Publication Data

US 2010/0005848 A1 Jan. 14, 2010

(51) Int. Cl.
*B21B 19/12* (2006.01)

(52) U.S. Cl. ..... 72/98; 72/31.03; 72/99; 72/365.2

(58) Field of Classification Search ..... 72/98, 99, 72/160, 162, 365.2, 367.1, 31.03, 31.06; 148/325, 336
See application file for complete search history.

(56) References Cited

U.S. PATENT DOCUMENTS

| | | | | | |
|---|---|---|---|---|---|
| 3,780,558 | A | * | 12/1973 | Lilienthal et al. | 72/98 |
| 4,534,197 | A | * | 8/1985 | Woolley | 72/98 |
| 4,763,504 | A | * | 8/1988 | Nilsson | 72/98 |
| 4,825,674 | A | * | 5/1989 | Tanaka et al. | 72/98 |
| 7,371,293 | B2 | * | 5/2008 | Nakashima et al. | 148/333 |
| 7,476,282 | B2 | * | 1/2009 | Tanida et al. | 148/325 |

FOREIGN PATENT DOCUMENTS

| | | | |
|---|---|---|---|
| JP | 55-103222 | * | 8/1980 |
| JP | 57-190722 | * | 11/1982 |
| JP | 58-164723 | * | 9/1983 |
| JP | 59-54421 | | 3/1984 |
| JP | 60-184424 | | 9/1985 |
| JP | 60-203321 | | 10/1985 |
| JP | 61-115619 | * | 6/1986 |
| JP | 62-56556 | | 3/1987 |
| JP | 1-123026 | | 5/1989 |
| JP | 2-207921 | | 8/1990 |
| JP | 4-72619 | | 11/1992 |
| JP | 5-132741 | | 5/1993 |
| JP | 6-17136 | * | 1/1994 |
| JP | 8-170153 | | 7/1996 |
| JP | 11-90511 | | 4/1999 |
| JP | 2001-179340 | | 7/2001 |
| JP | 2002-241838 | | 8/2002 |
| JP | 2005-138164 | | 6/2005 |

* cited by examiner

*Primary Examiner* — Edward Tolan
(74) *Attorney, Agent, or Firm* — Clark & Brody

(57) ABSTRACT

In straightening a duplex stainless steel pipe on a multi-roll pipe straightener, the value of A defined by the formula (1) is set to not more than 2.0% when it is not necessary to improve the mechanical strength of the pipe, and the value of A is set to more than 2.0% but not more than 3% when it is necessary to improve the mechanical strength of the pipe. Thereby, the mechanical strength of the duplex stainless steel pipe is regulated, $$A=(D_i-H_i)/D_i \quad (1)$$

where each of the symbols in the formula (1) indicates the following:

$D_i$: the outer diameter (mm) of the pipe at an entry side of an i-th stand in the straightener, and $H_i$: the gap (mm) between groove bottom portions of the rolls at an i-th stand in the straightener.

1 Claim, 2 Drawing Sheets

METHOD FOR PRODUCING DUPLEX STAINLESS STEEL PIPE, METHOD FOR STRAIGHTENING, METHOD FOR REGULATING STRENGTH, AND METHOD FOR OPERATING STRAIGHTENER

The disclosure of International Application No. PCT/JP2008/050325 filed Jan. 15, 2008 including specification, drawings and claims is incorporated herein by reference in its entirety.

1. Technical Field

The present invention relates to a method for producing a duplex stainless steel pipe, and more particularly to a straightening method using a straightener in a process for producing a duplex stainless steel pipe.

2. Background Art

A duplex stainless steel is a material having a high strength, as compared with an austenite stainless steel or a ferrite stainless steel, because a ferrite phase and an austenite phase are uniformly dispersed in the duplex stainless steel. The duplex stainless steel is easily processable for severe deformation and thus has been widely used for economical reasons in processability. In particular, The duplex stainless steel made of high-Cr and high-Mo has excellent corrosion resistance as well and thus the steel is used in many fields as a material for process-pipes and plumbing pipes in heat exchangers, and petroleum and chemical industries.

For instance, patent document 1 discloses a high strength duplex stainless steel containing elements having solid solution strengthening ability such as Cr, Mo, and N, and having excellent seawater resistance. Patent documents 2 and 3 disclose a high strength duplex stainless steel having highly resistance to corrosion improved by containing W in addition to Cr, Mo, and N.

Patent document 4 discloses a method for producing a duplex stainless steel pipe. This method has steps of preparing duplex stainless steel having a predetermined chemical composition and a parameter PI (=10C+16N+Si+1.2Mn+Ni+Co+Cr+3Mo) of 35 or higher, producing an untreated pipe by hot working, subjecting the untreated pipe to cold working or warm working with a cross sectional area reduction rate of 10% or more, and performing a solution heat treatment. The solution heat treatment is performed by raising the temperature with a predetermined heating rate in the range between 600 and 900° C., uniformly heating in a range between 1020 and 1180° C. for 1 minute or longer and rapid cooling.

As recited in the above documents, conventionally, the mechanical strength of the duplex stainless steel has been regulated by adjusting the chemical composition, controlling the condition of the solution heat treatment, and etc.

A duplex stainless steel pipe is produced by: adjusting the size of an untreated pipe by a sizer, a cutting machine, or the like; and correcting a bent portion of the pipe to straighten the pipe on a straightener while adjusting the outer perimeter of the elliptical shaped pipe.

Concerning the method for straightening seamless steel pipes, patent document 5 discloses a straightening method for improving the straightness of a pipe over the entire length with use of a multi-roll straightener constituted of multiple stands, wherein reentrant rolls are arranged opposite to each other or in a zigzag manner, and a 2-rolls straightener constituted of a pair of reentrant rolls or a pair of reentrant and convex rolls so as to reduce a pipe end margin to be cut in a cutting step.

FIG. 1 is a pattern diagram showing an example of a multi-roll pipe straightener. As shown in FIG. 1, the multi-roll straightener has three or more stands each equipped with a pair of hole-type rolls R and R. The hole-type rolls R and R hole-type are disposed opposite to each other with a predetermined inclination angle. The hole-type roll pairs are arranged such that the hole center axis of at least one stand (in the example of FIG. 1, the stand #2) is not aligned with the hole center axis of the other stands (hereinafter, this arrangement is referred to as "offset"). The gap between groove bottom portions of the hole-type roll pair R and R at each of the stands is set smaller than the outer diameter of a pipe P at an entry side of each stand. Accordingly, the pipe P is crushed while passing through each stand. In the multi-roll pipe straightener, since the pipe P is rotated in its circumferential direction while being fed in the direction of the arrow in FIG. 1, the bent portion of the pipe is straightened and the sectional shape thereof is adjusted.

The amounts of offset and the crush in the roll-type pipe straightener are important factors for the effect of straightening the pipe P. The applicant has proposed various methods for defining the offset amount and the crush amount.

For instance, the applicant proposed, in patent document 6, a method including: measuring a load to be applied to a hole-type roll arranged at each stand; and defining the offset amount and the crush amount so that the measured load is equal to a predetermined proper load.

The Applicant proposed, in patent document 7, a method including: estimating the amount of wear of a hole-type roll; and defining the offset amount and the crush amount depending on the estimated wear amount. In patent document 8, the Applicant proposed a method including defining the offset amount and the crush amount on the basis of a theoretical formula on deformation behavior of a pipe in a straightening step.

[Patent document 1] JP S62-56556 A
[Patent document 2] JP H05-132741 A
[Patent document 3] JP H08-170153 A
[Patent document 4] JP 2002-241838 A
[Patent document 5] JP 2005-138164 A
[Patent document 6] JP 2001-179340 A
[Patent document 7] JP H02-207921 A
[Patent document 8] JP H04-72619 B

DISCLOSURE OF THE INVENTION

Problems to be Solved by the Invention

The inventors conducted a study on how to regulate the mechanical strength of the duplex stainless steel pipes by means other than adjusting the chemical composition or controlling the condition of the solution heat treatment. As a result of the study, the inventors came up with an idea of using a straightener to be used in securing straightness and circularity of steel pipes. As a result of an extensive research, the inventors have found that the mechanical strength of the duplex stainless steel pipes can be regulated by adjusting the crush amount of a straightener, and accomplished the present invention.

As described above, patent documents 5 through 8 relating to a straightener made investigations about matters such as the improvement of the straightening effect and stability, but made no investigation about using a straightener to regulate the mechanical strength of the duplex stainless steel pipes.

It is an objective of the present invention is to provide a method for producing a duplex stainless steel pipe capable of regulating the mechanical strength thereof by means other than adjusting the chemical composition or controlling the condition of the solution heat treatment. And it is also an objective of the present invention is to provide a method for straightening, and a method for regulating the mechanical strength of the duplex stainless steel pipe, as well as a method for operating a straightener.

Means for Solving the Problems

The gist of the present invention is to a method for producing a duplex stainless steel pipe described (A), a method for regulating the strength described (B), method for straightening described (C), and a method for operating a straightener described (D).

(A) A method for producing a duplex stainless steel pipe characterized by using a multi-roll pipe straightener, straightening the duplex stainless steel pipe on an opposing pair of hole-type rolls, and setting the value of A defined by the formula (1) in a range of more than 2.0% but not more than 3% hole-type, $$A=(D_i-H_i)/D_i \quad (1)$$

where each of the symbols in the formula (1) indicates the following:

$D_i$: the outer diameter (mm) of the pipe at an entry side of an i-th stand in the straightener, and $H_i$: the gap (mm) between groove bottom portions of the rolls at an i-th stand in the straightener.

(B) A method for regulating a strength of a duplex stainless steel pipe characterized by using a multi-roll pipe straightener, straightening the duplex stainless steel pipe on an opposing pair of hole-type rolls, and setting the value of A defined by the formula (1) in a range of more than 2.0% but not more than 3%, $$A=(D_i-H_i)/D_i \quad (1)$$

where each of the symbols in the formula (1) indicates the following:

$D_i$: the outer diameter (mm) of the pipe at an entry side of an i-th stand in the straightener, and $H_i$: the gap (mm) between groove bottom portions of the rolls at an i-th stand in the straightener.

hole-type (C) A method for straightening a duplex stainless steel pipe characterized by using a multi-roll pipe straightener, straightening the duplex stainless steel pipe on an opposing pair of hole-type rolls, and setting the value of A defined by the formula (1) in a range of more than 2.0% but not more than 3%, $$A=(D_i-H_i)/D_i \quad (1)$$

where each of the symbols in the formula (1) indicates the following:

$D_i$: the outer diameter (mm) of the pipe at an entry side of an i-th stand in the straightener, and $H_i$: the gap (mm) between groove bottom portions of the rolls at an i-th stand in the straightener.

hole-type (D) A method for operating a straightener characterized by using a multi-roll pipe straightener, straightening the duplex stainless steel pipe on an opposing pair of hole-type rolls, and setting the value of A defined by the formula (1) in a range of not more than 2.0% when it is not necessary to improve the mechanical strength of the pipe, and setting the value of A in a range of more than 2.0% but not more than 3% when it is necessary to improve the mechanical strength of the pipe, $$A=(D_i-H_i)/D_i \quad (1)$$

where each of the symbols in the formula (1) indicates the following:

$D_i$: the outer diameter (mm) of the pipe at an entry side of an i-th stand in the straightener, and $H_i$: the gap (mm) between groove bottom portions of the rolls at an i-th stand in the straightener.

hole-type

Effect of the Invention

According to the present invention, the mechanical strength of the duplex stainless steel pipes can be regulated by the straightener, thereby obtaining greater flexibility of chemical composition and heat treatment conditions.

BEST MODE FOR CARRYING OUT THE INVENTION

Figure 1:
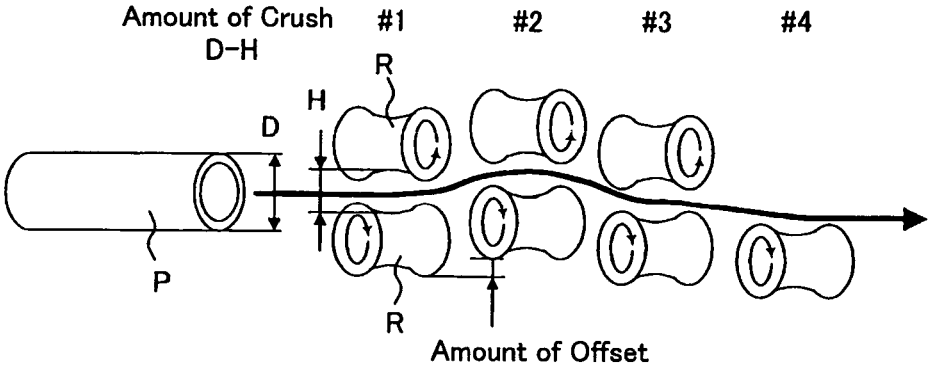
FIG. 1 is a pattern diagram showing an example of a multi-roll pipe straightener.

In the present invention, in straightening a duplex stainless steel pipe on a multi-roll pipe straightener (hereinafter simply referred to as "straightener"), the value of A defined by the formula (1) is set the value of A defined by the formula (1) in a range of not more than 2.0% when it is not necessary to improve the mechanical strength of the pipe, and the value of A is set in a range of more than 2.0% but not more than 3% when it is necessary to improve the mechanical strength of the pipe, $$A=(D_i-H_i)/D_i \quad (1)$$

where each of the symbols in the formula (1) indicates the following:

$D_i$: the outer diameter (mm) of the pipe at an entry side of an i-th stand in the straightener, and $H_i$: the gap (mm) between groove bottom portions of the rolls at an i-th stand in the straightener.

The value of A indicates the ratio of the crush amount of the duplex stainless steel pipe on the straightener with respect to the outer diameter of the pipe. If the value of A is not more than 2.0%, the mechanical strength of the pipe does not change before and after the straightening. Accordingly, the strength, which is obtained by properly adjusting the chemical composition and the condition of the heat treatment, can be maintained. The inventors found that the mechanical strength of the duplex stainless steel pipe increases if the value of A is more than 2.0%. The crush amount may be controlled so that the value of A is set in a range of more than 2.0% if it is necessary to improve the mechanical strength which is obtained by properly adjusting the chemical composition and the condition of the heat treatment.

The value of A is desirably set to not less than 2.5%. The tensile strength at normal temperature and high temperature (120° C.) can be enforced by adjusting the crush amount so that the value of A is set to not less than 2.5%. This is found by the research of the inventors. The upper limit of the value of A is not specifically limited, but an excessively large crush amount may deteriorate the toughness, although the strength is increased. In view of this, the value of A is desirably set to not more than 3.0%.

The outer diameter of the pipe can be measured by, for instance, a method using a measuring apparatus disposed on the entry side of the straightener, a method that calculates the outer diameter of the entry side of the straightening based on the measured outer diameter of the pipe on the exit side of hot working, and so on. It may be omitted to measure the outer diameter of a pipe between the stands by regarding that the outer diameter of the pipe at the entry side of each stand is equal to the gap between the groove bottom portions of the rolls at the previous stand.

The offset amount (the distance between the center hole axes of the hole-type roll pair R and R which arranged offset and another hole-type rolling roll pair R and R) is not specifically limited, but preferably approximately 5% of the outer diameter of the pipe at the entry side of the straightening.

Thus, according to the present invention, it is possible to straighten the duplex stainless steel pipe, and further to regulate the strength of the pipe by using a straightener. Further, it is possible to produce the steel pipes, having different strengths from each other, from the duplex stainless steel untreated pipes having the same chemical composition.

EXAMPLE

Untreated pipes (outer diameter: 219.1 mm, inner diameter: 159.1 mm, length: 8000 mm) of duplex stainless steels as shown in Table 1 were produced in order to confirm the effects of the present invention. Then, the untreated pipes were subjected to solution treatment (1080° C.×30 minutes) and straightening on a straightener. The straightener was used with varied crushing conditions.

TABLE 1

| | Chemical Compositions(mass %, balance being Fe and impurities) | | | | | | | | | | |
|---|---|---|---|---|---|---|---|---|---|---|---|
| Charge | C | Si | Mn | P | S | Cu | Cr | Ni | Mo | Nb | N |
| A | 0.019 | 0.33 | 0.44 | 0.023 | 0.0005 | 0.45 | 24.78 | 6.65 | 3.09 | 0.012 | 0.30 |
| B | 0.014 | 0.38 | 0.45 | 0.024 | 0.0009 | 0.48 | 24.98 | 6.61 | 3.09 | 0.005 | 0.30 |
| C | 0.014 | 0.37 | 0.49 | 0.025 | 0.0005 | 0.52 | 24.76 | 6.66 | 3.11 | 0.006 | 0.28 |

Tensile tests at normal temperature and 120° C. and Charpy tests (−50° C., 2 mm V-shaped notch) were performed with varying chemical compositions and crushing conditions, and mechanical strengths of the pipes were examined. The results are shown in Table 2.

TABLE 2

| | | Value | Strength (MPa) | | | | |
|---|---|---|---|---|---|---|---|
| | | of A | Nomal Temp. | | 120° C. | | Toughness |
| No. | Charge | (%) | YS | TS | YS | TS | evaluation |
| 1 | A | 0.6 | 606 | 847 | 461 | 742 | ○ |
| 2 | A | 0.6 | 598 | 845 | 455 | 730 | ○ |
| 3 | A | 1.3 | 612 | 850 | 457 | 731 | ○ |
| 4 | A | 1.3 | 608 | 846 | 458 | 735 | ○ |
| 5 | A | 1.3 | 608 | 847 | 462 | 740 | ○ |
| 6 | A | 1.3 | 598 | 847 | 462 | 738 | ○ |
| 7 | A | 2.1 | 616 | 849 | 456 | 736 | ○ |
| 8 | A | 2.1 | 614 | 845 | 461 | 736 | ○ |
| 9 | A | 2.6 | 618 | 849 | 472 | 735 | ○ |
| 10 | A | 2.6 | 620 | 844 | 469 | 739 | ○ |

TABLE 2-continued

| | | Value | Strength (MPa) | | | | |
|---|---|---|---|---|---|---|---|
| | | of A | Nomal Temp. | | 120° C. | | Toughness |
| No. | Charge | (%) | YS | TS | YS | TS | evaluation |
| 11 | A | 2.8 | 623 | 846 | 475 | 738 | ○ |
| 12 | A | 3.2 | 635 | 849 | 490 | 740 | ○ |
| 13 | A | 3.2 | 630 | 854 | 490 | 732 | X |
| 14 | A | 3.2 | 618 | 859 | 478 | 736 | X |
| 15 | B | 0.6 | 610 | 858 | 468 | 741 | ○ |
| 16 | B | 0.6 | 612 | 854 | 469 | 740 | ○ |
| 17 | B | 0.6 | 608 | 848 | 468 | 738 | ○ |
| 18 | B | 0.6 | 608 | 854 | 470 | 741 | ○ |
| 19 | C | 0.6 | 604 | 846 | 456 | 721 | ○ |
| 20 | C | 0.6 | 610 | 847 | 465 | 733 | ○ |

Value of A is defined by formula (1).
Toughness was evaluated by the percent fracture of the longitudinal derection at −50° C.
○: it did not exist less than 50% of percent fracture in the specimens.
X: it existed less than 50% of percent fracture in the specimens.

Figure 2:
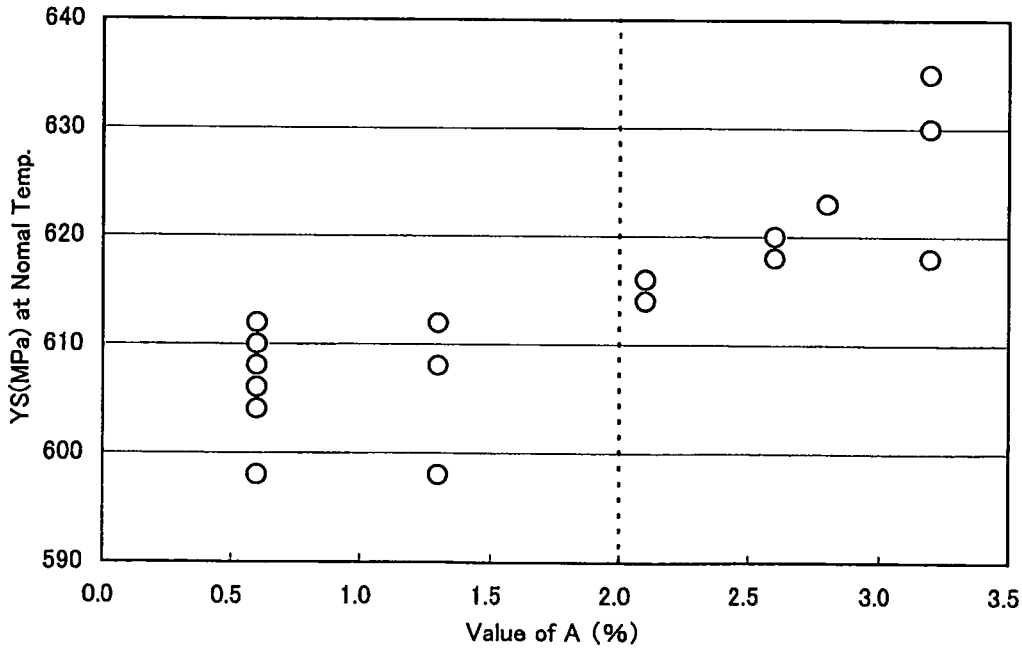
FIG. 2 is a diagram showing the results of the Example organized into a relation between YS and the value of A at normal temperature.
Figure 3:
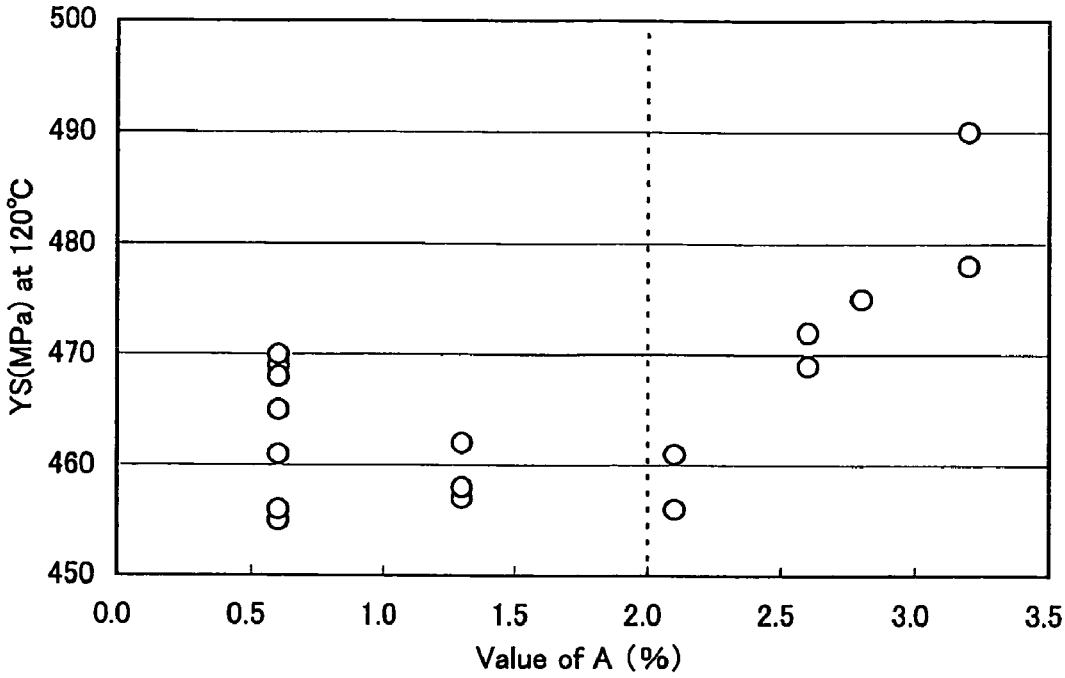
FIG. 3 is a diagram showing the results of Example organized into a relation between YS and the value of A at 120° C.

FIGS. 2 and 3 are organized diagrams of the results shown in Table 2. FIG. 2 shows a relationship between YS and the value of A at normal temperature, and FIG. 3 shows a relationship between YS and the value of A at 120° C.

As shown in Table 2 and FIG. 2, YS at normal temperature showed substantially no change when A was not more than 2.0%, while gradually increasing when A was in excess of 2.0%. In some of the pipes (Nos. 13 and 14) where the value of A was in a range in excess of 3.0%, the toughness deteriorates. Also, as shown in Table 2 and FIG. 3, YS at 120° C. significantly enforced when A was in excess of 2.5%.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

According to the present invention, the mechanical strength of the duplex stainless steel pipes can be regulated by the straightener, thereby obtaining greater flexibility of chemical composition and heat treatment conditions.

The invention claimed is:

1. A method for improving strength of a duplex stainless steel pipe having a microstructure where a ferrite phase and an austenite phase are uniformly dispersed comprising:

using a multi-roll pipe straightener, straightening the duplex stainless steel pipe on an opposing pair of hole-type rolls, and setting the value of A defined by the formula (1) in a range of more than 2.5% but not more than 3% , $$A=(D_i-H_i)/D_i \quad (1)$$

where each of the symbols in the formula (1) indicates the following:

$D_i$: the outer diameter (mm) of the pipe at an entry side of an i-th stand in the straightener, and $H_i$: the gap (mm) between groove bottom portions of the rolls at an i-th stand in the straightener.

* * * * *

UNITED STATES PATENT AND TRADEMARK OFFICE

CERTIFICATE OF CORRECTION

PATENT NO. : 8,006,528 B2
APPLICATION NO. : 12/458508
DATED : August 30, 2011
INVENTOR(S) : Osako It is certified that error appears in the above-identified patent and that said Letters Patent is hereby corrected as shown below:

Title Page:

Related U.S. Application Data item 60 should be listed as follows:
Continuation of application No. PCT/JP2008/050325, filed on Jan. 15, 2008.

Foreign Application Priority Data item 30 should be listed as follows:
Jan. 16, 2007 (JP) ..... 2007-006577

Signed and Sealed this
Tenth Day of April, 2012

David J. Kappos

David J. Kappos
*Director of the United States Patent and Trademark Office*